United States Patent [19]

Lewer et al.

[11] 4,247,221

[45] Jan. 27, 1981

[54] PROCESS FOR LINING TUNNELS

[75] Inventors: Hans Lewer, Witten-Annen; Dieter Poller, Dortmund; Günter Seifert, Cologne, all of Fed. Rep. of Germany

[73] Assignee: Kali und Salz AG, Kohl, Fed. Rep. of Germany

[21] Appl. No.: 1,518

[22] Filed: Jan. 30, 1979

[30] Foreign Application Priority Data

May 2, 1978 [DE] Fed. Rep. of Germany ..... 281923

[51] Int. Cl.[3] ..... E21D 11/00

[52] U.S. Cl. ..... 405/150; 405/146; 405/152

[58] Field of Search ..... 405/146, 147, 150, 152, 405/288, 289; 264/31, 32; 299/11

[56] References Cited

U.S. PATENT DOCUMENTS

| | | | |
|---|---|---|---|
| 2,148,783 | 2/1939 | Spaulding | 405/150 |
| 3,334,162 | 8/1967 | Lauffer et al. | 264/32 |

FOREIGN PATENT DOCUMENTS

| | | | |
|---|---|---|---|
| 2558442 | 7/1977 | Fed. Rep. of Germany | 405/150 |
| 347147 | 7/1960 | Switzerland | 405/150 |
| 565937 | 8/1975 | Switzerland | 405/150 |

*Primary Examiner*—David H. Corbin

*Attorney, Agent, or Firm*—Millen & White

[57] ABSTRACT

Plastic hose means, preferably of high pressure polyethylene admixed with a flame retarding agent and treated to render the same antistatic and characterized by a resistance to tearing of at least 15 N/mm$^2$, an extension of at least 450 percent, a resistance to piercing of at least 1.5 J and a resistance to continued tearing of at least 17 N/mm, are disclosed, as is a process for using the hose means for filling the space between the rock face of a mine or tunnel and the supporting structure therefor.

11 Claims, 3 Drawing Figures

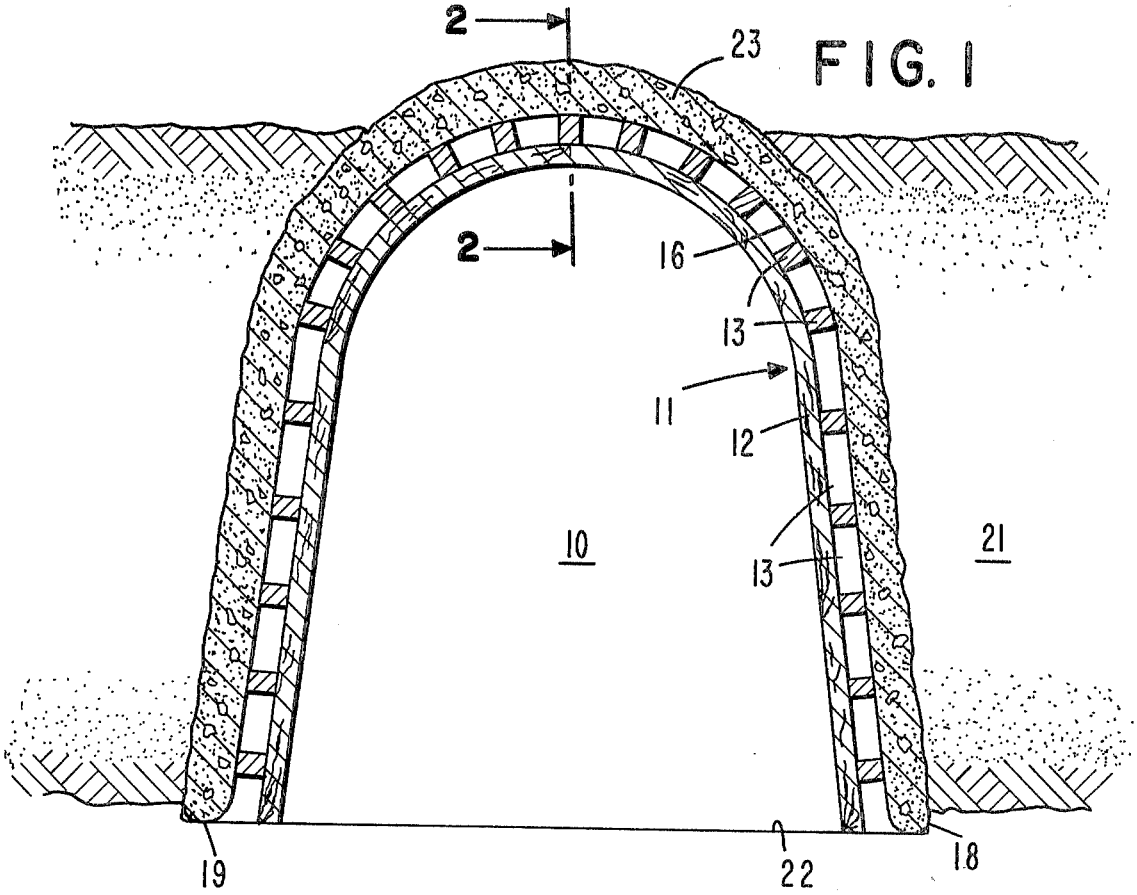
FIG. 1
FIG. 2
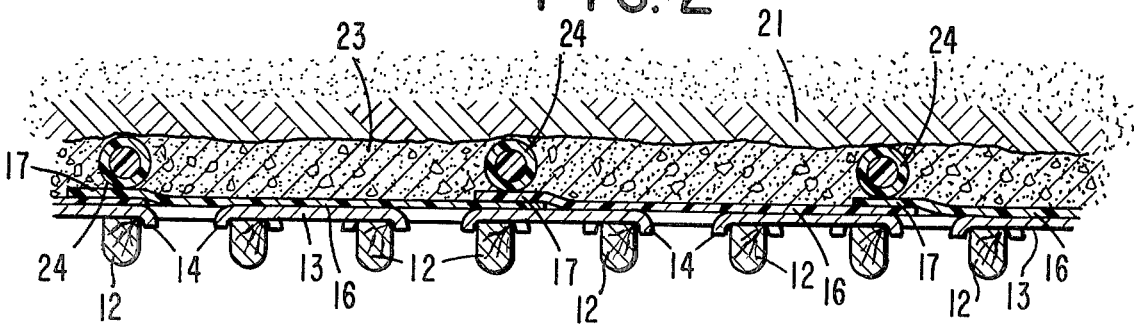
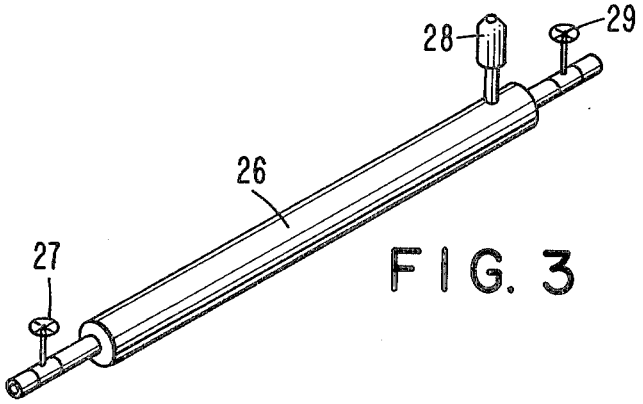
FIG. 3

PROCESS FOR LINING TUNNELS

BACKGROUND OF THE INVENTION

In mining and tunnel construction, the tunnels generally are formed by means of drilling or blasting, or with the aid of various types of cutting machines. During such tunneling it is often unavoidable for the working faces to become larger than the useful and/or desired cross sections, especially in cases where the rock being worked is not compact. Therefore, for reasons of safety and in order to maintain the predetermined useful cross section, the driven tunnels generally are provied with a support or lining. When such supports are utilized it is necessary for the hollow space between the elements of the support and the solid rock of the working faces to be filled in, in order to prevent rock movement and to transfer the rock pressure evenly to the support.

The filling in of the hollow spaces between the working faces of the tunnel and the support may be accomplished in a variety of ways. For example, after a support has been constructed from sheathing of timber, metal sheets, meshed wire, concrete slabs or the like, the hollow space remaining between the support and the working faces of the tunnel may be packed with loose rocks obtained during the tunneling operation. Another known technique comprises filling the space between the sheathing elements of the support and the rock face with concrete or some other quick setting building material. Still another technique, known as the Torkret process, requires less of a material expenditure and merely comprises the application of a several centimeter thick layer of sprayed concrete (gunite) to the rock-face of the tunnel after blasting, whereby the inherent bearing strength of the rock is increased.

According to a more recent technique, plastic hoses are inserted between the rock face and the sheathing, which in this case consists of meshed wire mats disposed on timber support elements. A liquid plastic foam material is then pumped into the hoses and permitted to solidify. In this manner the hollow spaces between the rock face and the support are filled with a cushion formed by the foam-filled hoses.

The demands to be made of this foam-filled hose cushion however, are extremely critical. First of all the hose must be made from a material which can satisfy the requirements for the protection of the miners, for example, with respect to flame resistance and electrical conductivity. The hose material also should be harmless with regard to the health of the miners; for example, it should not result in the formation of any harmful decomposition products. The hose material, furthermore, must have a capacity for extension such that the cushions, developing during filling, will completely fill all hollow spaces, thereby preventing the escape of any accumulations of mine gasses, which escape from the rocks. In addition, the hose material must exhibit an acceptable ductility and tear resistance so that the hose will be able to absorb an operating pressure of at least about 5 bar without tearing. The hoses must also exhibit a resistance to piercing which is as high as possible since the hoses are to be used in conjunction with sheathing of wire or the like which often contains projecting points or edges. At the same time, a high strength against continued tearing is desirable so that minor damage to the skin of a hose will not become the starting point for extensive tears. Finally, one should expect from the hose material, that it will hold the compressed plastic foam together so strongly, that the resulting cushions, despite the relatively low resistance to pressure of the unsupported plastic foam, will absorb relatively high pressure loads and will be capable of transferring such loads to the tunnel support. The hose materials used in the prior art have not fulfilled the above noted requirements, or at least not all of them.

SUMMARY OF THE INVENTION

Accordingly, it is an object of the present invention to provide plastic hoses for filling the hollow spaces between the rock face of a mine or tunnel and the support therefor, which hoses will overcome the disadvantages of the prior art.

It is another object of the invention to provide a process for filling the space between the working faces of a mine or tunnel and the support therefor which will overcome the difficulties and deficiencies of prior art processes.

These and other objects and advantages are accomplished in accordance with the present invention by providing plastic hoses which are characterized by consisting of a high pressure polyolefin, particularly polyethylene, to which has been added suitable flame retarding and antistatic agents, and which exhibits a lengthwise and widthwise resistance to tearing of at least 15 $N/mm^2$, a lengthwise and widthwise tear-extension of at least 450%, a resistance to piercing of at least 1.5 J, and a continued tearing resistance of at least 17 N/mm.

Among the flame retarding agents suitable for addition the hose material according to the invention, there may be listed all of the halogenated hydrocarbons known for their flame retardant characteristics, particularly the halogenated aromatic compounds such as the highly brominated aromatic compounds. Decabromo diphenylether is an example of one such brominated aromatic compound. Other suitable flame retardants include inorganic compounds such as antimony trioxide. Mixtures of various flame retardants, such as a mixture of decabromo diphenylether and antimony trioxide have been found to be particularly suitable.

The hoses may be rendered antistatic by the addition of known agents such as graphite powder, metal powders and the like. In one preferred embodiment, the antistatic properties of the hoses may be accomplished by imprinting the hoses, for example, in the shape of a grid using a conductive soot-containing dye.

By using the plastic hoses of the invention, the work of filling the hollow spaces between the rock face of tunnels and the support therefor in mining operations, as well as in case of tunnel construction, may be considerably simplified. However, filling the entire space between the support and the rock face with foam-filled hoses is not always completely satisfactory since the low pressure resistance of the filler material can not prevent rock movements or the absorption of such movement in every case. Moreover, it has been found to be desirable if not necessary to use light-meshed sheathing mats in order to prevent a pressing through and tearing of the foam-filled hoses.

Thus, even greater advantages are attained by using the plastic foam-filled hoses of the invention in conjunction with a process for filling of hollow spaces between the rock face and the tunnel support with a building material which exhibits substantial compressive strength, such as concrete or mortar. This process involves converting the support sheathing with flat webs or sheets of plastic film material, which preferrably correspond in length to the length of the lift or support periphery, inserting the hoses to be filled with foam in the length of the tunnel periphery and parallel to the direction of the webs of plastic film material, filling the hoses with foam material and then filling the hollow space between the foam-filled hoses and plastic film material with a setting or hardening building material.

The invention will be understood more fully in view of the following detailed description thereof, particularly when taken in conjunction with the drawing.

BRIEF DESCRIPTION OF THE DRAWINGS

FIG. 1 is a schematic cross-sectional view illustrating a fully supported tunnel;

FIG. 2 is a schematic cross-sectional view taken along line 2—2 of FIG. 1 illustrating the manner in which the space between the support structure and the rock face is filled, the view depicting a portion of the space running parallel to the axis of the tunnel; and FIG. 3 is a perspective, schematic view of an air-tight plastic hose having suitable valve means through which a compressed gas may be introduced into the hose to thereby inflate the same.

DETAILED DESCRIPTION OF THE PREFERRED EMBODIMENT

Referring now to the drawings, there is shown in FIG. 1 a tunnel 10 which is supported by a structure designated generally by the numeral 11. The support structure 11 is comprised of timber or other suitable support elements 12 on which are placed a plurality of sheathing elements 13, such as wire mesh webs. As shown in FIG. 2, the sheathing elements 13 may be arranged over the support elements 12 in a staggered fashion and may have their ends 14 turned down slightly to help keep them in place. A plurality of relatively narrow, elongated sheathing mats or plastic sheets 16 are positioned over the sheathing elements 13 preferably such that the longitudinal edges 17 of adjacent sheets 16 overlap. The sheets 16 preferably are of a length sufficient to traverse the entire periphery of the support structure 11, and optionally, may be bent back at their opposite ends 18, 19 to define grooved or channel-like area adjacent the rock face 21 at the tunnel floor 22.

The hollow space between sheathing and rock face, as well as the channel-like area adjacent the tunnel floor is filled with the building material 23. In FIG. 2, a sectional view through the support structure 11 along the intersecting line 2—2 of FIG. 1 is shown, which view runs parallel to the axis of the tunnel. In this figure, not only is there shown the deposition of the sheathing elements 13 relative to the support elements 12 and the overlapping plastic sheets 16, but there is shown the foam-filled plastic hoses 24 and the building material filler 23 as well. As discussed above, the longitudinal direction or axis of the hoses 24 is parallel to the longitudinal direction of the plastic sheets 16 and each hose 24 generally is of a length sufficient to extend the entire periphery of the support structure 11. While the number and size of the hoses 24 traversing the length of the tunnel may vary, depending, at least in part, upon the length of the periphery of the support structure 11, it is preferable that at least one length of hose 24 be used for each length of plastic sheet 16. As illustrated in FIG. 2, it is also preferred that a length of hose 24 be disposed at least over each overlapping edge 17 of adjacent plastic sheets and that the hose be of a size such that when filled with foam material the hoses contact both the plastic sheets 16 and the rock face 21 and define a seal which is capable of preventing the escape of any accumulated gases.

In order to carry out the process of the invention, a first web or sheet 16 of flat plastic film material is placed directly on the sheathing elements 13 such that the sheet extends from the tunnel floor on one side of the tunnel, up, over and down the entire circumference or periphery of the support structure 11, and to the floor on the other side of the tunnel. As indicated above, the sheet 16 may be bent over at each end 18, 19 to define a channel-like area for receiving the filling material 23. Next, a second sheet 16 is placed over the sheathing elements in the same manner as the first sheet, preferably, so that the edge of the second sheet overlaps the edge of the first sheet. This procedure is continued until a sufficient number of sheets 16 have to be placed on the sheathing elements to cover a predetermined depth of the tunnel support. Next, after removing any loose rock and adjusting the sheets 16, the hollow plastic hoses of this invention are put in place over the sheets 16, the hoses being generally of the same length as the sheets 16 or as the tunnel periphery. Subsequently, the hoses are foamed in a manner known per se, for example, with plastic foam until a tight closure is produced between the plastic sheets 16 and the rock face 21. The remaining hollow space between the sheets 16 and the rock face 21 is then filled with the building material filler 23, for example, by means of a filler hose (not shown) guided through, above, or below the foam-filled hose seals. In this manner, the hollow space between the sheets 16 and the rock face 21 is filled completely with a suitable substance, for example, a concrete mixture. When the filling of the hollow space is finished, the filler hose is removed and any apertures formed in the foam-filled hoses by the filler hose are closed.

Although the above method of operation considerably simplifies and accelerates the filling of the hollow spaces between the support structure and the rock face, an even greater simplification may be achieved by inserting air-tight plastic hoses 26 (FIG. 3) provided with a fill-up valve means 27 into the spaces to be filled and by subsequently inflating them up, for example, with compressed air. Such hoses, for the purpose of adaptation to the various hollow spaces to be encountered, may be produced in a variety of shapes and sizes, and may be characterized, for example, by various color codings to facilitate their selection for a particular end use.

The blowing up or inflation of the hoses 26 may be accomplished most simply by means of compressed air, which may be taken from the compressed air supply normally associated with mining and tunnel construction by means of a conventional pressure reducing valve. After reaching a filling pressure of about 0.05 to 0.1 bar, the hoses 26 generally will fit tightly against the rock face 21 and at the same time against the support structure 11, so that the support structure is guyed solidly with the rock face. Should the rock pressure increase after some time at individual places, a slow escape of the excess pressure developed in the hoses 26 could be made possible by an excess pressure relief valve 28 suitably attached to each hose. In such case the air within each hose 26 would be vented until the rock fits against the support structure and the rock pressure is absorbed directly thereby. Thus, it will be appreciated that the use of hoses filled with compressed air makes possible a quick filling up of the hollow spaces between the rock face and support structure. Such use also insures the working space against ripping of rocks and prevents, moreover, the accumulation of explosive gasses. However, as against the rock pressure, hoses filled with compressed air often are too flexible. This disadvantage may be avoided, however, by using the compressed air only as a temporary means for expanding the hoses 26. Thus, after advancing the support structure 11 a predetermined depth into a mine or tunnel, say 10 to 50 meters, the air in the hoses 26 may be removed by means of valve 27 and replaced by foam material or building materials of a higher compressive strength.

According to this latter method of operation, the hoses 26 are first inserted behind the support structure 11, for example, by rounds of shots in a known manner, in such numbers and sizes as required. The hoses are then filled with compressed air, the space behind the support thus being filled with the hose cushions or seals. This work may be carried out quickly and with minimal apparatus. As soon as the rock face has moved forward into the tunnel by about 10 to 50 meters by the progress of the tunneling operation, the compressed air filling in the hoses 26 near the entrance of the tunnel, is replaced according to the invention, by a filling of foam material or with building materials of a higher compressive strength. By continually proceeding into the tunnel in this manner, the working space for the change of fillings lies far enough behind the work front so that the two jobs will not impede each other either temporarily or with regard to a need for space for the required working apparatus and materials. In this manner, a depth of about 10 to 50 meters having a support filled by air cushions is succeeded by a support having hoses filled by solidified foam or building materials.

Substances, which after a certain time set into a compact mass, are suitable as building materials for use in the present invention, among such materials may be included foamed plastics, such as for example, urea-formaldehyde resins, as well as concrete, mortar or other conventional inorganic settable materials. Foamed plastics, such as urea-formaldehyde resins, may be employed as the foam material for use in the present invention.

There are a number of ways in which the air-filled hose 26 can be filled with the building material. For example, the filling may take place by way of the valve means 27 provided for the filling with air. In such cases, an aperture is formed in the hose 26 to allow the air to escape while a suitable filling hose induces the building material through the valve means 27. It is also possible, to equip the hoses with a second valve means 29, so that the air within the hose will escape only at the rate that it is displaced by the building material. In this manner, the hollow space always remains completely filled by the hose cushion. Another technique comprises piercing the hoses 26 with an appropriate lance and then introducing the building material through the resulting aperture.

It is to be understood that the above-described embodiments are simply illustrative of the principles of the invention. Thus, although the invention has been described in connection with various hose means, per se, and several specific techniques for using such hose means for filling and sealing the space between the rock face of a mine or tunnel and the structure for supporting the same, it is to be understood that the uses of such hose means are not so limited and they may be employed for other applications as well. Moreover, various other modifications and changes may be devised by those skilled in the art which will embody the principles of the invention and fall within the spirit and scope of the following claims.

What is claimed is:

1. A method for filling the space between the rock face of a tunnel or mine and the structure for supporting the same which comprises:

placing a plurality of lattice sheathing elements on the structure for supporting the rock face of the mine or tunnel such that said sheathing selments define a substantially continuous covering on the supporting structure adjacent the periphery of the rock face;

placing a plurality of flat sheets of plastic film over said sheathing elements such that said sheets of plastic film define a substantially continuous covering over said sheathing elements;

positioning a plurality of plastic hose means over said sheets of plastic film, said hose means being of a length sufficient to extend the entire length of the periphery of the rock face;

filling each of said hose means with a foam material; and filling the remaining hollow space between said plastic sheets of film and the rock face with a settable building material.

2. The method of claim 1 wherein said hose means are comprised of a high pressure polyolefin selected from the group consisting of polyethylene and polypropylene, wherein said polyolefin has a flame retarding agent admixed therewith, and wherein said hose means exhibits a lengthwise and widthwise tear resistance of at least 15 $N/mm^2$, an extension at tear lengthwise and widthwise of at least 450 percent, a resistance to piercing of at least 1.5 J, and a continued tearing resistance of at least 17 N/mm.

3. The method of claim 2 wherein said hose means further comprises an antistatic agent, and wherein said hose means are filled with sufficient amounts of foam material such that said hose means are in sealing contact with said plastic film sheets and the rock face.

4. The process of claim 2 wherein said flat sheets of plastic film material are placed on said sheathing elements such that the edges of adjacent sheets of plastic film overlap and wherein said plastic hose means are positioned at least on each overlapping edge of said sheets of plastic film.

5. The process of claim 3 wherein said flat sheets of plastic film material are placed on said sheathing elements such that the edges of adjacent sheets of plastic film overlap and wherein said plastic hose means are positioned at least on each overlapping edge of said sheets of plastic film.

6. A method for filling the space between the rock face of a tunnel or mine and the structure for supporting the same which comprises:

placing a plurality of lattice sheathing elements on the structure for supporting the rock face of the mine or tunnel such that said sheathing elements define a substantially continuous covering on the supporting structure adjacent the periphery of the rock face;

placing a plurality of flat sheets of plastic film over said sheathing elements such that said sheets of plastic film define a continuous covering over said sheathing elements;

positioning a plurality of air-tight plastic hose means over said sheets of plastic film, said hose means having filler valve means and being of a length sufficient to extend the entire length of said periphery of the rock face; and filling each of said hose means with a compressed gas to expand said hose means into sealing contact with said sheets of plastic film and the rock face.

7. The method of claim 6 further comprising filling the remaining hollow space between said plastic sheets of film and the rock face with a settable building mateiral.

8. The method of claim 6 where said hose means are comprised of a high pressure polyolefin selected from the group consisting of polyethylene and polypropylene, wherein said polyolefin has a flame retarding agent admixed therewith, and wherein said hose means exhibits a lengthwise and widthwise resistance of at least 15 $N/mm^2$, an extension at tear lengthwise and widthwise of at least 450 percent, a resistance to piercing of at least 1.5 J, and a continued tearing resistance of at least 17 N/mm.

9. The method of claim 6 wherein the compressed gas filling said hose means, after an advance of the support into the mine or tunnel by about 10 to 50 meters, is removed therefrom and replaced by filling said hose means with building materials of a higher compressive strength.

10. The method of claim 7 wherein the compressed gas filling said hose means, after an advance of the support into the mine or tunnel by about 10 to 50 meters, is removed therefrom and replaced by filling said hose means with building materials of a higher compressive strength.

11. The method of claim 8 wherein the compressed gas filling said hose means, after an advance of the support into the mine or tunnel by about 10 to 50 meters, is removed therefrom and replaced by filling said hose means with building materials of a higher compressive strength.

* * * * *